US006866894B2

(12) United States Patent
Trankiem et al.

(10) Patent No.: US 6,866,894 B2
(45) Date of Patent: Mar. 15, 2005

(54) RAZOR BLADE TECHNOLOGY

(75) Inventors: Hoang Mai Trankiem, Plymouth, MA (US); Michael J. Paretchan, North Weymouth, MA (US); Colin Clipstone, Weston, MA (US); Steve Syng-Hi Hahn, Wellesley, MA (US); Neville Sonnenberg, Newton, MA (US); Charles White, Lynnfield, MA (US); Andrew Zhuk, Action, MA (US); Kevin P. McDonough, West Roxbury, MA (US)

(73) Assignee: The Gillette Company, Boston, MA (US)

( * ) Notice: Subject to any disclaimer, the term of this patent is extended or adjusted under 35 U.S.C. 154(b) by 135 days.

(21) Appl. No.: 10/192,418

(22) Filed: Jul. 10, 2002

(65) Prior Publication Data

US 2003/0096060 A1 May 22, 2003

Related U.S. Application Data

(63) Continuation-in-part of application No. 09/515,421, filed on Feb. 29, 2000, now Pat. No. 6,684,513.

(51) Int. Cl.[7] ..... B05D 7/14
(52) U.S. Cl. ..... 427/385.5
(58) Field of Search ..... 427/385.5, 409

(56) References Cited

U.S. PATENT DOCUMENTS

| | | | | |
|---|---|---|---|---|
| 3,345,202 | A | | 10/1967 | Kiss et al. |
| 3,480,483 | A | | 11/1969 | Wilkinson |
| 3,508,957 | A | | 4/1970 | Blochl |
| 3,518,110 | A | * | 6/1970 | Fischbein ..... 428/335 |
| 3,743,551 | A | | 7/1973 | Sanderson |
| 3,754,329 | A | | 8/1973 | Lane |
| 3,774,703 | A | | 11/1973 | Sanderson |
| 3,837,896 | A | | 9/1974 | Lindstrom et al. |
| 3,838,512 | A | | 10/1974 | Sanderson |
| 3,890,109 | A | | 6/1975 | Jones |
| 3,911,579 | A | | 10/1975 | Lane et al. |
| 4,416,912 | A | | 11/1983 | Bache |
| 4,933,058 | A | | 6/1990 | Bache et al. |
| 4,960,643 | A | | 10/1990 | Lemelson |
| 5,032,243 | A | | 7/1991 | Bache et al. |
| 5,142,785 | A | | 9/1992 | Grewal et al. |
| 5,232,568 | A | | 8/1993 | Parent et al. |
| 5,263,256 | A | | 11/1993 | Trankiem |
| 5,295,305 | A | | 3/1994 | Hahn et al. |
| 5,480,527 | A | | 1/1996 | Welty |
| 5,497,550 | A | | 3/1996 | Trotta et al. |
| 5,669,144 | A | | 9/1997 | Hahn et al. |
| 5,799,549 | A | | 9/1998 | Decker et al. |
| 5,918,369 | A | | 7/1999 | Apprille, Jr. et al. |
| 5,940,975 | A | | 8/1999 | Decker et al. |
| 5,985,459 | A | | 11/1999 | Kwiecien et al. |

FOREIGN PATENT DOCUMENTS

| | | |
|---|---|---|
| EP | 0 591 339 B1 | 4/1994 |
| EP | 884 142 A1 | 12/1998 |
| WO | WO 92/19425 | 11/1992 |

OTHER PUBLICATIONS

Krytox® LW–1200, Krytox® performance lubricants, Jun. 1996.

* cited by examiner

*Primary Examiner*—Erma Cameron
(74) *Attorney, Agent, or Firm*—Fish & Richardson P.C.

(57) ABSTRACT

A razor blade including a substrate with a cutting edge defined by a sharpened tip and adjacent facets, a layer of hard coating on the cutting edge, an overcoat layer of a chromium containing material on the layer of hard carbon coating, and an outer layer of polytetrafluoroethylene coating over the overcoat layer. Also disclosed is a method of making a razor blade including providing a substrate with a cutting edge defined by a sharpened tip and adjacent facets, and applying an aqueous solution including polytetrafluoroethylene coating over the sharpened tip to result in an outer layer, the polytetrafluoroethylene having a molecular weight of about 45,000.

15 Claims, 1 Drawing Sheet

RAZOR BLADE TECHNOLOGY

This application is a continuation-in-part (and claims the benefit of priority under 35 U.S.C. §120) of U.S. application Ser. No. 09/515,421 filed on Feb. 29, 2000, now U.S. Pat. No. 6,684,513, issued Feb. 3, 2004.

TECHNICAL FIELD

The invention relates to improvements to razors and razor blades.

BACKGROUND

A razor blade is typically formed of a suitable substrate material such as stainless steel, and a cutting edge is formed with a wedge-shaped configuration with an ultimate tip having a radius less than about 1000 angstroms, e.g., about 200–300 angstroms. Hard coatings such as diamond, amorphous diamond, diamond-like carbon (DLC) material, nitrides, carbides, oxides or ceramics are often used to improve strength, corrosion resistance and shaving ability, maintaining needed strength while permitting thinner edges with lower cutting forces to be used. Polytetrafluoroethylene (PTFE) outer layer can be used to provide friction reduction. Interlayers of niobium or chromium containing materials can aid in improving the binding between the substrate, typically stainless steel, and hard carbon coatings, such as DLC. Examples of razor blade cutting edge structures and processes of manufacture are described in U.S. Pat. Nos. 5,295,305; 5,232,568; 4,933,058; 5,032,243; 5,497,550; 5,940,975; 5,669,144; EP 0591334; and PCT 92/03330, which are hereby incorporated by reference.

In use, the ultimate tip of the edges having hard coatings and polytetrafluoroethylene outer layers can become more rounded after repeated shaves such that there is an increase in the tip radius and a generally perceived decrease in shaving performance.

SUMMARY

In one aspect the invention features, in general, a method of making a razor blade including providing a substrate with a cutting edge defined by a sharpened tip and adjacent facets, and applying an aqueous solution including polytetrafluoroethylene coating over the sharpened tip to result in an outer layer, the polytetrafluoroethylene having a molecular weight of about 45,000.

In preferred embodiments the aqueous solution has 0.3% to 1% solids in water and a pH between 9 and 10, a particle size of less than about 0.1 micron and contains nonionic surfactant In another aspect, the invention features, in general, a razor blade including a substrate with a cutting edge defined by a sharpened tip and adjacent facets, a layer of hard coating on the cutting edge, an overcoat layer of a chromium containing material on the layer of hard coating, and an outer layer of polytetrafluoroethylene coating on the overcoat layer.

In another aspect the invention features, in general, a shaving razor including a handle and a razor head with a blade having a substrate with a cutting edge defined by a sharpened tip and adjacent facets, a layer of hard coating on the cutting edge, an overcoat layer of a chromium containing material on the layer of hard coating, and an outer layer of polytetrafluoroethylene coating on the overcoat layer.

Particular embodiments of the invention may include one or more of the following features. In particular embodiments, the hard coating material can be made of carbon containing materials (e.g., diamond, amorphous diamond or DLC), nitrides, carbides, oxides or other ceramics. The hard coating layer can have a thickness less than 2,000 angstroms. The overcoat layer can be made of chromium or a chromium containing alloy compatible with polytetrafluoroethylene such as a chromium platinum alloy. The overcoat layer can be between 100 and 500 angstroms thick. The blade can include an interlayer between the substrate and the layer of hard coating. The interlayer can include niobium or a chromium containing material. The polytetrafluoroethylene can be Krytox LW1200 available from DuPont. The PTFE outer layer can be between 100 and 5000 angstroms thick.

In another aspect, the invention features, in general, making a razor blade by providing a substrate with a cutting edge defined by a sharpened tip and adjacent facets, adding a layer of hard coating on the cutting edge, adding an overcoat layer of a chromium containing material on the layer of hard coating, and adding an outer layer of polytetrafluoroethylene coating over the overcoat layer.

Particular embodiments of the invention may include one or more of the following features. In particular embodiments the layers can be added by physical vapor deposition (i.e., sputtering) or by chemical vapor deposition. The chromium containing layer, preferably chromium, can be sputter deposited under conditions that result in a compressively stressed coating. The sputter deposition of chromium containing materials can include applying a DC bias to the target that is more negative than −50 volts, preferably more negative than −200 volts. Alternatively an appropriate RF bias scheme can be used to achieve an equivalent chromium layer.

Embodiments of the invention may include one or more of the following advantages. The use of a chromium containing overcoat layer provides improved adhesion of the polytetrafluorethylene outer layer to the hard coating layer. The razor blade has improved edge strength provided by hard coating and has reduced tip rounding with repeated shaves. Reduced tip rounding minimizes the increase in cutting force thereby maintaining excellent shaving performance. The razor blade has excellent shaving characteristics from the first shave onwards.

Other features and advantages of the invention will be apparent from the following description of a particular embodiment and from the claims.

The details of one or more embodiments of the invention are set forth in the accompanying drawings and the description below. Other features, objects, and advantages of the invention will be apparent from the description and drawings, and from the claims.

DESCRIPTION OF A PARTICULAR EMBODIMENT

Figure 1:
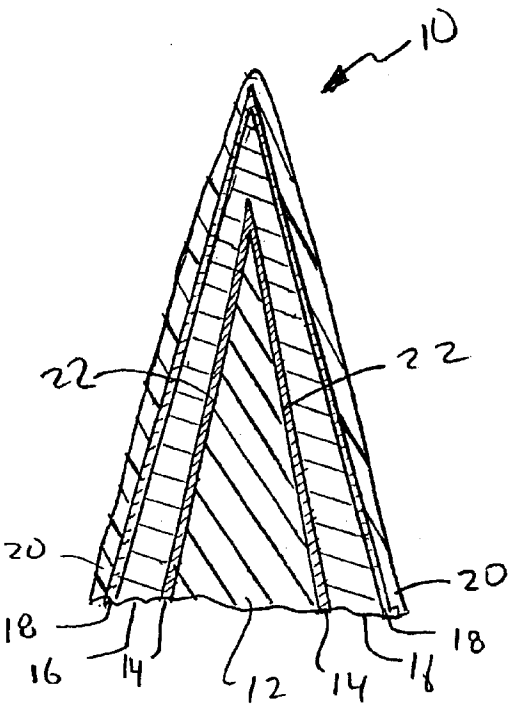
FIG. 1 is a vertical sectional view of a cutting edge portion of a razor blade.

Referring to FIG. 1, there is shown razor blade 10 including substrate 12, interlayer 14, hard coating layer 16, overcoat layer 18, and outer layer 20. The substrate 12 is typically made of stainless steel (though other substrates can be employed) and has an ultimate edge sharpened to a tip radius of less than 1,000 angstroms, preferably 200 to 300 angstroms, and has a profile with side facets 22 at an included angle of between 15 and 30 degrees, preferably about 19 degrees, measured at 40 microns from the tip.

Interlayer 14 is used to facilitate bonding of the hard coating layer to the substrate. Examples of suitable interlayer material are niobium and chromium containing material. A particular interlayer is made of niobium greater than 100 angstroms and preferably less than 500 angstroms thick. PCT 92/03330 describes use of a niobium interlayer.

Hard coating layer 16 provides improved strength, corrosion resistance and shaving ability and can be made from carbon containing materials (e.g., diamond, amorphous diamond or DLC), nitrides (e.g., boron nitride, niobium nitride or titanium nitride), carbides (e.g., silicon carbide), oxides (e.g., alumina, zirconia) or other ceramic materials. The carbon containing materials can be doped with other elements, such as tungsten, titanium or chromium by including these additives, for example in the target during application by sputtering. The materials can also incorporate hydrogen, e.g., hydrogenated DLC. Preferably coating layer 16 is made of diamond, amorphous diamond or DLC. A particular embodiment includes DLC less than 2,000 angstroms, preferably less than 1,000 angstroms. DLC layers and methods of deposition are described in U.S. Pat. No. 5,232,568. As described in the "Handbook of Physical Vapor Deposition (PVD) Processing," DLC is an amorphous carbon material that exhibits many of the desirable properties of diamond but does not have the crystalline structure of diamond.

Overcoat layer 18 is used to reduce the tip rounding of the hard coated edge and to facilitate bonding of the outer layer to the hard coating while still maintaining the benefits of both. Overcoat layer 18 is preferably made of chromium containing material, e.g., chromium or chromium alloys that are compatible with polytetrafluoroethylene, e.g., CrPt. A particular overcoat layer is chromium about 100–200 angstroms thick. Blade 10 has a cutting edge that has less rounding with repeated shaves than it would have without the overcoat layer.

Outer layer 20 is used to provide reduced friction and includes polytetrafluoroethylene and is sometimes referred to as a telomer. A particular polytetrafluoroethylene material is Krytox LW 1200 available from DuPont. This material is a nonflammable and stable dry lubricant that consists of small particles that yield stable dispersions. It is furnished as an aqueous dispersion of 21.5±1% solids by weight, pH 9 to 10, with primary particles less than 0.1 micron in size and includes 5% or more of nonanionic surfactant. The small particle size facilitates spraying. The surfactant facilitates suspension of small particles, avoids agglomerates and promotes a thin, uniform surface coating. The polytetrafluoroethylene material melts at 323–328° C., preferably 325–327° C. It has a molecular weight of about 45,000 (e.g., ±1,000). It has a reversible heat of fusion of 50 to 65 Joules/g.

The aqueous solution can be applied by dipping, spraying, or brushing, and can thereafter be air dried or melt coated.

Preferably the aqueous solution is diluted to 0.3% to 1% (preferably about 0.62%) with purified (e.g. by reverse osmosis) water and shaken and sprayed onto the exposed edges (facet regions) of a stack of preheated blades. The stack is then placed in an oven to raise the temperature above the melting temperature to melt and spread the material. The heating is carried out in an inert atmosphere of nitrogen or argon.

The layer is preferably less than 5,000 angstroms and could typically be 1,500 angstroms to 4,000 angstroms, and can be as thin as 100 angstroms, provided that a continuous coating is maintained. Provided that a continuous coating is achieved, reduced telomer coating thickness can provide improved first shave results. U.S. Pat. Nos. 5,263,256 and 5,985,459, which are hereby incorporated by reference, describe techniques which can be used to reduce the thickness of an applied telomer layer.

Razor blade 10 is made generally according to the processes described in the above referenced patents. A particular embodiment includes a niobium interlayer14, DLC hard coating layer 16, chromium overcoat layer 18, and Krytox LW1200 polytetrafluoroethylene outer coat layer 20. Chromium overcoat layer 18 is deposited to a minimum of 100 angstroms and a maximum of 500 angstroms. It is deposited by sputtering using a DC bias (more negative than −50 volts and preferably more negative than −200 volts) and pressure of about 2 millitorr argon. The increased negative bias is believed to promote a compressive stress (as opposed to a tensile stress), in the chromium overcoat layer which is believed to promote improved resistance to tip rounding while maintaining good shaving performance. Blade 10 preferably has a tip radius of about 200–400 angstroms, measured by SEM after application of overcoat layer 18 and before adding outer layer 20.

Figure 2:
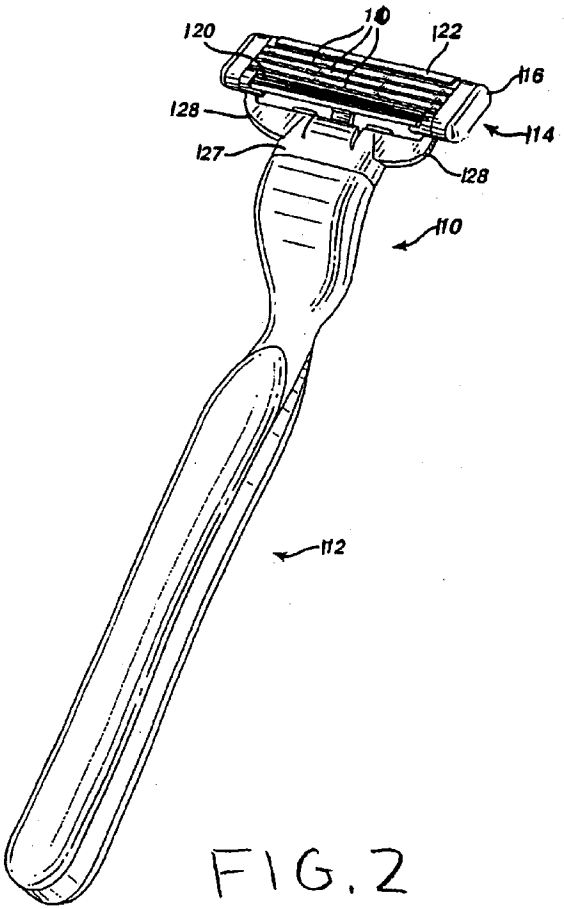
FIG. 2 is a perspective view of a shaving razor including the FIG. 1 razor blade.

Referring to FIG. 2, blade 10 can be used in shaving razor 110, which includes handle 112 and replaceable shaving cartridge 114. Cartridge 14 includes housing 116, which carries three blades 10, guard 120 and cap 122. Blades 10 are movably mounted, as described, e.g., in U.S. Pat. No. 5,918,369, which is incorporated by reference. Cartridge 114 also includes interconnect member 124 on which housing 116 is pivotally mounted at two arms 128. Interconnect member 124 includes a base 127 which is replaceably connected to handle 112. Alternatively, blade 10 can be used in other razors having one, two or more than three blades, double-sided blades, and razors that do not have movable blades or pivoting heads where the cartridge is either replaceable or permanently attached to a razor handle.

In use, razor blade 10 has excellent shaving characteristics from the first shave onwards. Blade 10 has improved edge strength provided by hard coating and has reduced tip rounding with repeated shaves provided by the overlayer coating while maintaining excellent shave characteristics.

The particular polytetraflourethylene coating applied provides reduced coefficient of friction when cutting.

Other embodiments of the invention are within the scope of the appended claims.

What is claimed is:

1. A method of making a razor blade comprising providing a substrate with a cutting edge defined by a sharpened tip and adjacent facets, and applying an aqueous solution including polytetrafluoroethylene coating over said sharpened tip to result in an outer layer, said polytetrafluoroethylene having a molecular weight of about 45,000, and having a primary particle size less than 0.1 micron.

2. The method of claim 1 wherein said aqueous solution contains nonionic surfactant.

3. The method of claim 1 further comprising providing a layer of hard coating on said cutting edge before said applying.

4. The method of claim 3 further comprising providing an overcoat layer of a chromium containing material on said layer of hard coating before said applying.

5. The method of claim 3 further comprising providing an interlayer on said substrate before providing said layer of hard coating.

6. The method of claim 5 wherein said interlayer comprises niobium.

7. The method of claim 5 wherein said interlayer comprises a chromium containing material.

8. The method of claim 3 wherein said hard coating comprises diamond like carbon.

9. The method of claim 4 wherein said hard coating comprises amorphous diamond.

10. The method of claim 4 wherein said hard coating layer has a thickness less than 2,000 angstroms.

11. The method of claim 4 wherein said overcoat layer is between 100 and 500 angstroms thick.

12. The blade of claim 1 wherein said outer layer is between 100 and 5,000 angstroms thick.

13. The method of claim 4 wherein said overcoat layer consists of chromium.

14. The method of claim 4 wherein said overcoat layer consists of a chromium containing alloy.

15. The method of claim 4 wherein said overcoat layer consists of a chromium platinum alloy.

* * * * *